US006948634B2

(12) United States Patent
Evans et al.

(10) Patent No.: US 6,948,634 B2
(45) Date of Patent: Sep. 27, 2005

(54) SOLID DOSAGE FORM DISPENSER

(75) Inventors: Christopher T. Evans, Long Valley, NJ (US); Christopher Gieda, Long Valley, NJ (US)

(73) Assignee: Warner-Lambert Company LLC, Morris Plains, NJ (US)

( * ) Notice: Subject to any disclaimer, the term of this patent is extended or adjusted under 35 U.S.C. 154(b) by 0 days.

(21) Appl. No.: 10/104,852

(22) Filed: Mar. 21, 2002

(65) Prior Publication Data

US 2002/0175180 A1 Nov. 28, 2002

Related U.S. Application Data

(60) Provisional application No. 60/293,687, filed on May 25, 2001.

(51) Int. Cl.[7] ..... B65G 59/06

(52) U.S. Cl. ..... 221/202; 221/263; 221/289; 221/204

(58) Field of Search ..... 221/289, 298, 221/263, 264, 202, 200

(56) References Cited

U.S. PATENT DOCUMENTS

| | | | | |
|---|---|---|---|---|
| 1,196,105 A | | 8/1916 | Groom | |
| 1,880,823 A | | 10/1932 | Cooper | |
| 1,948,227 A | | 2/1934 | Rechten | |
| 2,683,554 A | | 7/1954 | Mulhauser, Jr. | |
| 3,191,803 A | | 6/1965 | Hamilton | |
| 3,332,576 A | | 7/1967 | Hamilton | |
| 3,896,967 A | | 7/1975 | Doolittle | |
| 4,354,619 A | | 10/1982 | Wippermann et al. | |
| 4,402,425 A | | 9/1983 | von Schuckmann | |
| 4,492,316 A | * | 1/1985 | Emms | 221/202 |
| 4,653,668 A | | 3/1987 | Gibilisco et al. | |
| 5,018,644 A | | 5/1991 | Hackmann et al. | |
| 5,108,006 A | | 4/1992 | Tieke et al. | |
| 5,174,471 A | | 12/1992 | Kozlowski et al. | |
| 5,405,047 A | * | 4/1995 | Hansen | 221/190 |
| 5,553,739 A | | 9/1996 | Plum et al. | |
| 5,657,901 A | | 8/1997 | Farside | |
| 5,816,441 A | | 10/1998 | Farside | |
| 5,954,228 A | | 9/1999 | Minnette | |

FOREIGN PATENT DOCUMENTS

| | | | | |
|---|---|---|---|---|
| DE | 4201995 A1 | * | 7/1993 | B65D/83/06 |
| EP | 408774 A1 | * | 1/1991 | B65D/83/04 |

* cited by examiner

*Primary Examiner*—Donald P. Walsh
*Assistant Examiner*—Kaitlin Joerger
(74) *Attorney, Agent, or Firm*—Kenneth G. Lemke; Evan J. Federman

(57) ABSTRACT

A dispenser for dispensing solid dosing forms which include a storage compartment and a releasing portion at the bottom of the storage compartment. The releasing portion is adapted to receive a releasing device which dispenses a single solid dosage form while providing security against the release of multiple solid dosage forms as well as clogging which may prevent the release of a single solid dosage form.

21 Claims, 7 Drawing Sheets

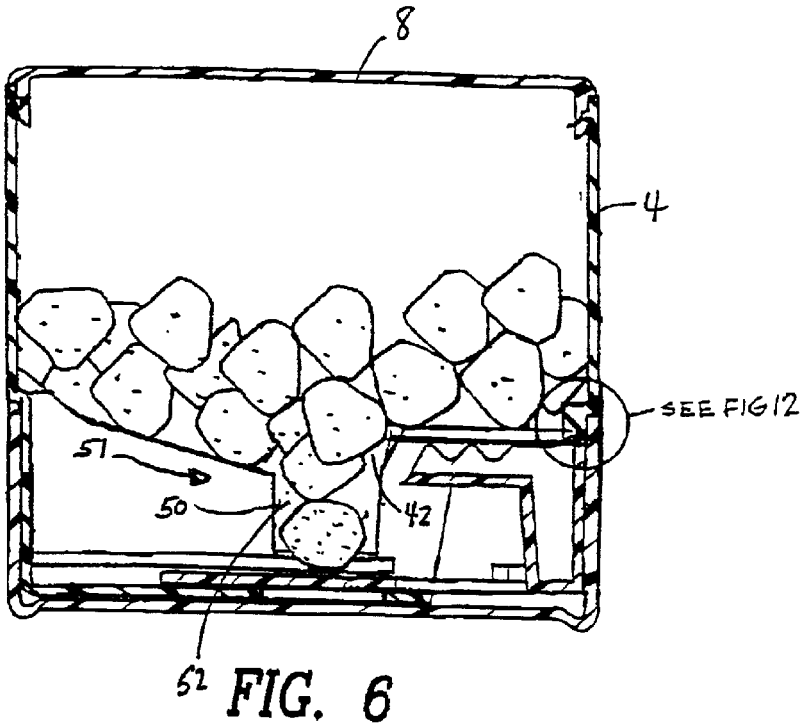
FIG. 6
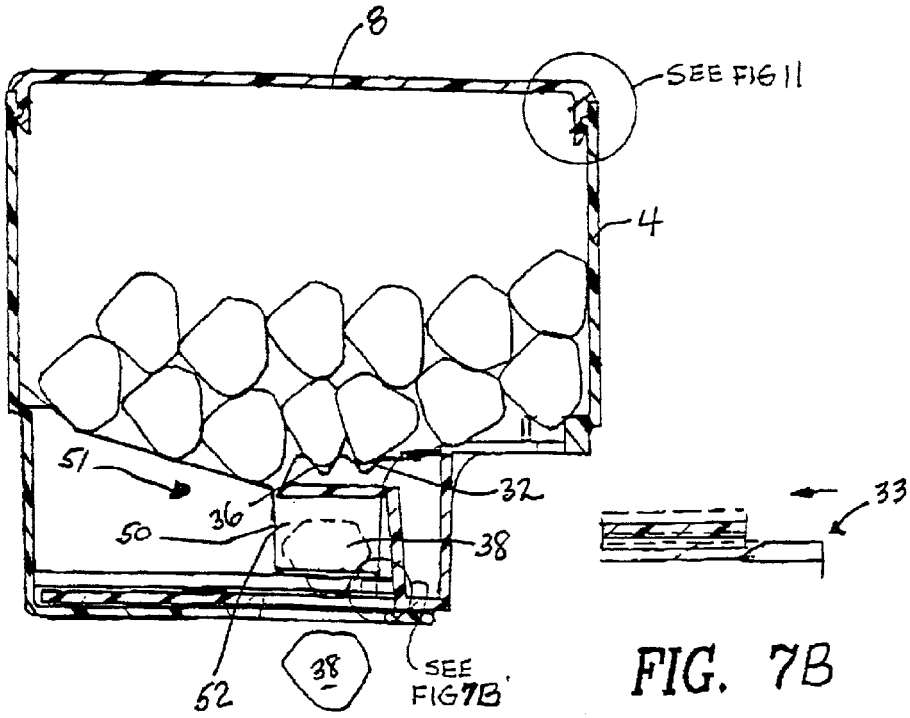
FIG. 7B
FIG. 7A

SOLID DOSAGE FORM DISPENSER

This application claims the benefit of U.S. Provisional Patent Application No. 60/293,687 filed on May 25, 2001, the entirety of which is hereby incorporated by reference as if fully set forth herein.

FIELD OF THE INVENTION

The present invention is directed to a dispenser for dispensing a solid dosage form such as a tablet to a user. The dispenser is easily held in the hand and enables the user to uniformly dispense a single solid dosage form and prevents against undesirable clogging or inadvertent release of multiple solid dosage forms. The dispenser also provides a substantially water vapor imperable environment to prevent moisture from contacting the solid dosage form when the dispenser is not in use.

BACKGROUND OF THE INVENTION

Dispensers for releasing solid dosage forms such as tablets, capsules, caplets and the like are known in the art. Various structures have been developed to ensure a single solid dosage form is released when the dispenser is activated by the user. Examples of such devices are disclosed in U.S. Pat. Nos. 2,683,554; 3,191,803; 3,332,576; 4,354,619; 4,402,425; 4,492,316; 4,653,668; 5,018,664; 5,108,006; 5,174,471; 5,657,901; and 5,816,441.

It is desirable for a solid dosage form dispenser to consistently release only a single dosage form at a time until all of the solid dosage forms contained within the dispenser are released. One problem with prior dispensers is that upon occasion more than one solid dosage form is released at a time. The release of multiple solid dosage forms presents a number of difficulties to the user. First, the extra or additional solid dosage forms must be handled by the user. The user may have to discard the extras or return them to the dispenser which takes time and is annoying to the user. If the user chooses to return the solid dosage form to the dispenser, the dispenser must be opened which is often disadvantageous because many solid dosage forms are sensitive to moisture and in some cases may be hygroscopic. For some applications, it may be desirable to provide a dispenser which can not be opened or which can not be easily opened by the user. These types of dispensers may be preferred for highly water sensitive solid dosage forms and/or for medications whose administration must be very carefully controlled. Accordingly, the user would have to find another place to store the extra or discard the same.

Another disadvantage of typical solid dosage form dispensers is that the compartment for storing the solid dosage forms can become clogged, especially in proximity to the opening where the solid dosage form is discharged from the storage compartment. This presents a number of problems to the user. For example, the user must then open the pill dispenser, empty the contents and hope that the clog can be eliminated without damage to the solid dosage forms. The opening of the container for the removal or elimination of a clog can result in damage to some of the solid dosage forms as well as contamination by the excessive handling of the contents of the dispenser.

If the dispenser can not be opened because it is of the permanent sealed type or can not be easily opened, then the user is at least temporarily without access to the solid dosage form and has to return the same to the retailer who may then have to return the same to the manufacturer, all of which results in disruption, loss of time and increase cost of the dispenser.

A further disadvantage of typical dispensers for releasing solid dosage forms is that they do not provide a substantially water vapor impermeable environment for the solid dosage forms especially when the dispenser is not in use. By preventing significant contact with water vapor, the solid dosage forms within the dispenser have an extended shelf life and can therefore be dispensed over longer periods of time without loss of efficacy.

It would therefore be a significant advance in the art of providing dispensers for the distribution of solid dosage forms if a dispenser could be provided which distributes a single solid dosage form at a time and prevents against dispensing of multiple solid dosing forms as well as clogging so that the user is assured of receiving the proper solid dosage form a single dose at a time.

It would be a further advance in the art to provide a dispenser which provides substantial protection against moisture.

It would be a still further advance in the art to provide a dispenser which is relatively to simple to manufacture and which provides all of the features necessary to ensure distribution of a single solid dosage form upon activation by the user.

SUMMARY OF THE INVENTION

The present invention is generally directed to a dispenser for dispensing a solid dosage form in which a single solid dosage form is dispensed at a time and the dispenser prevents against dispensing multiple solid dosage forms as well as clogging which can result in the inability of the dispenser to deliver any solid dosage forms.

In a particular aspect of the present invention, there is provided a dispenser for dispensing a solid dosage form comprising:

a) a housing comprising a storage compartment for storing a solid dosage form and having a first opening, a solid dosage form releasing portion operatively connected to the storage compartment for receiving and supporting a solid dosage form received through the first opening and having a second opening for receiving a solid dosage form releasing device, and a third opening for releasing the solid dosage form from the dispenser;

b) said solid dosage form releasing device comprising:

1) reversible moving means for reversibly moving the releasing device from a passive position to an active position for releasing a single solid dosage form from the dispenser through the third opening; and 2) disengaging means for disengaging the solid dosage form from the solid dosage form releasing portion.

BRIEF DESCRIPTION OF THE DRAWINGS

The following drawings in which like reference characters indicate like parts are illustrative of embodiments of the invention and are not intended to limit the invention as encompassed by the claims forming part of application.

FIG. 6 is a cross-sectional view of the solid dosage form dispensing device of FIG. 1 showing the solid dosage form releasing device in the passive position;

FIG. 7A is a cross-sectional view similar to FIG. 6 showing the solid dosage form releasing device in the active position for the release of a single solid dosage form;

FIG. 7B is a cross-sectional view of a portion of the solid dosage form releasing device particularly adapted to disengage the single solid dosage form so that it may be released from the dispensing device;

DETAILED DESCRIPTION OF THE INVENTION

Figure 1:
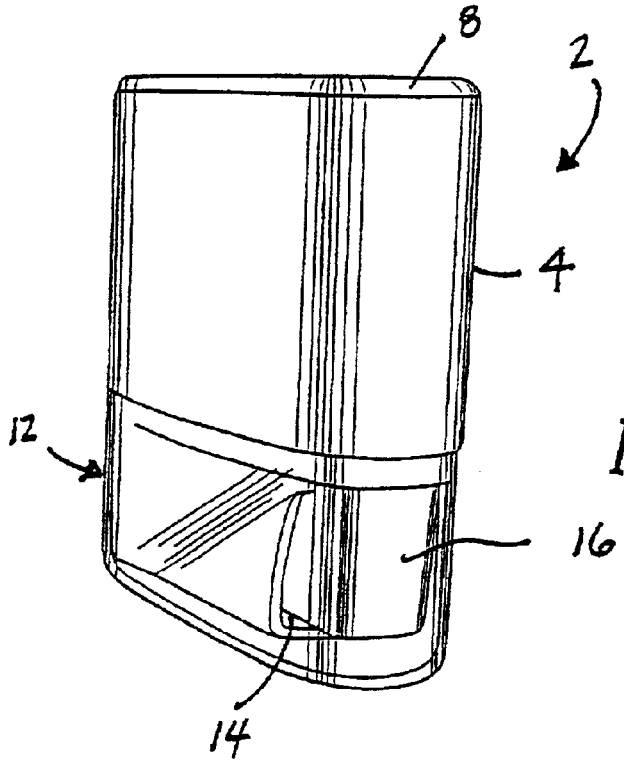
FIG. 1 is a perspective view of an embodiment of a solid dosage form dispensing device of the present invention where the releasing device is in the active position.
Figure 2:
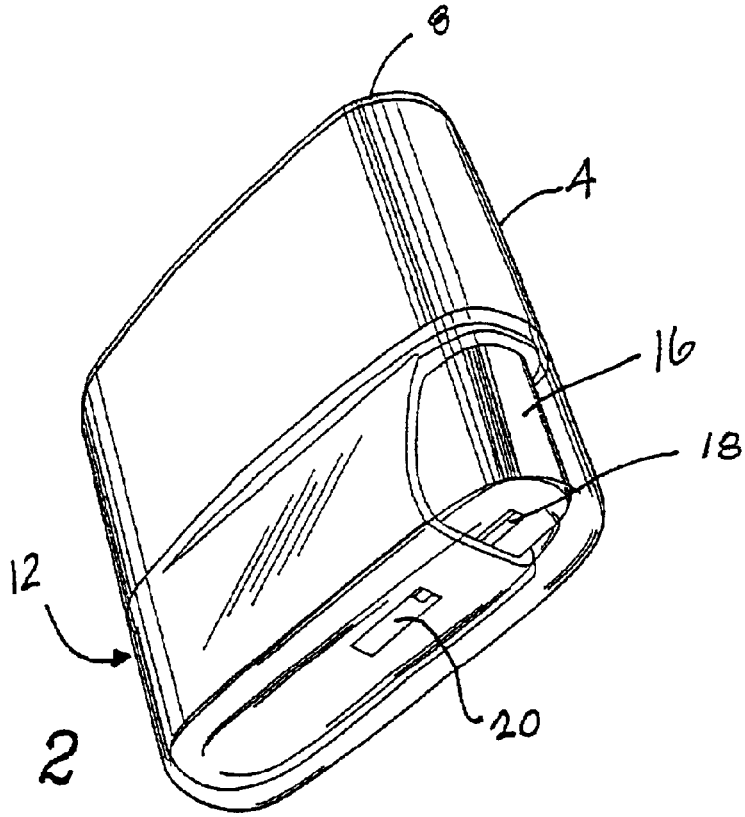
FIG. 2 is a perspective view similar to FIG. 1 showing the bottom portion of the dispensing device with an opening for releasing a single solid dosage form.

The present invention is generally directed to a solid dosage form dispensing device for dispensing a single solid dosage form to a user upon activation of the device. As used herein, the term "solid dosage form" shall mean any dosage form that is in the form of a solid including, but not limited to, tablets, caplets, capsules including those made from hard or soft materials such as gelatin or natural or synthetic gelatin substitutes, lozenges, combinations thereof and the like.

The solid dosage form may contain medications whether prescription or non-prescription as well as, vitamins, nutraceuticals, cough medications, mineral and/or herb supplements whether natural or synthetic, combinations thereof and the like. It will be understood that the content of the solid dosage form (e.g. the type of active agent) is non-limiting with respect to the dispenser described herein and any active agent contained within a solid dosage form may be dispensed in accordance with the present invention.

Referring to the drawings and first to FIGS. 1–4 there is shown a preferred embodiment of the solid dosage form dispenser (hereinafter dispenser) generally shown by the reference numeral 2. The dispenser 2 has a housing 4 including an upper portion defining a storage compartment 6 (see FIG. 5). The storage compartment is either permanently sealed or has a removable lid 8 which allows access to the storage compartment and enables the dispenser to be refilled as necessary. It will be understood that in one embodiment of the present invention, the pill dispenser has a unitary construction in which the solid dosage form is permanently packaged at a manufacturing facility and is not thereafter opened by the user. Instead, once the user has dispensed all of the solid dosage forms contained therein, the dispenser may be discarded. In other embodiments of the invention as described in detail hereinafter, the lid is releasably secured to the housing through a moisture preventing seal system to keep moisture away from the solid dosage forms stored within the storage compartment 6.

Figure 5:
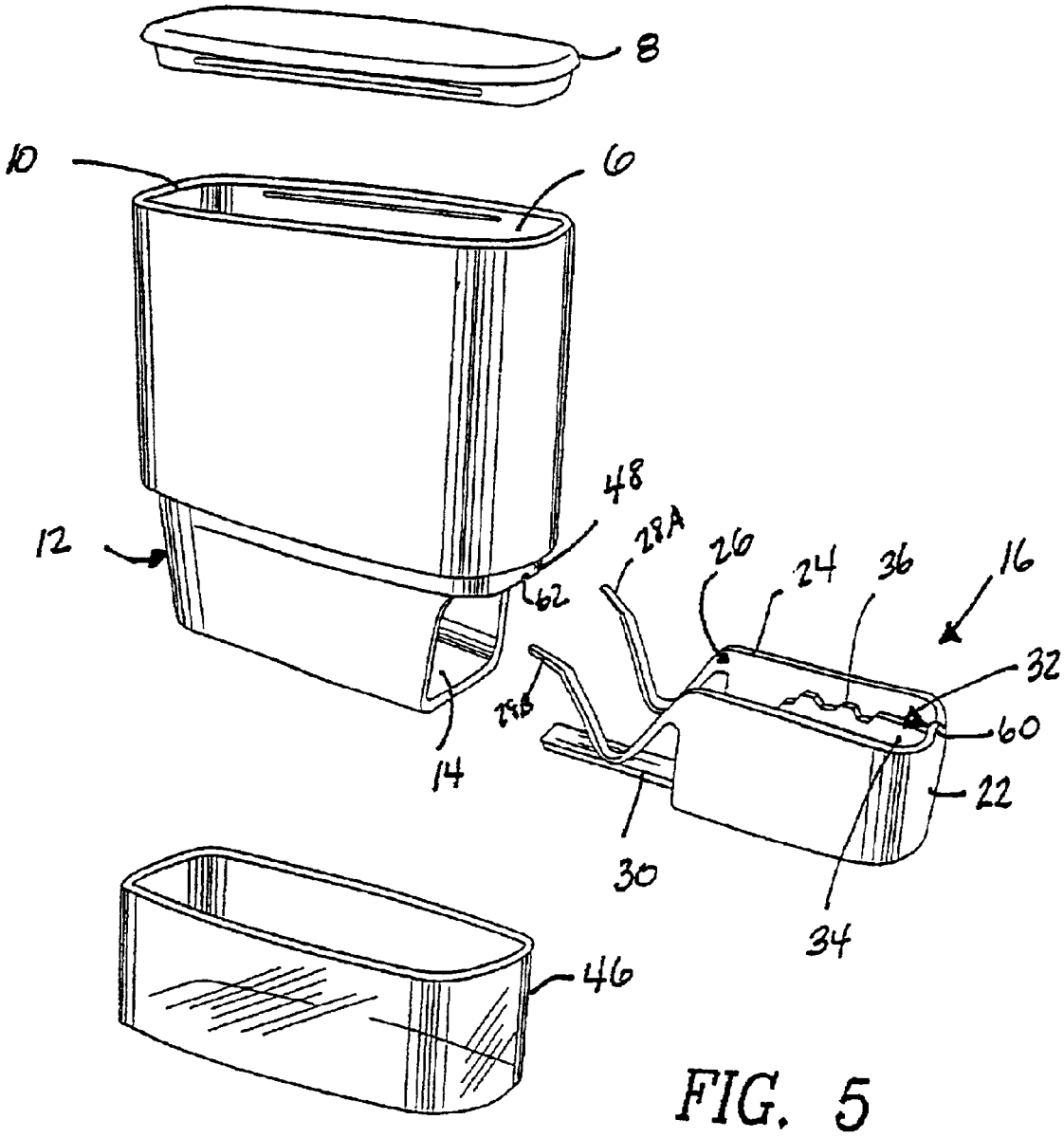
FIG. 5 is an exploded view of the solid dosage form dispensing device shown in FIG. 1.
Figure 8:
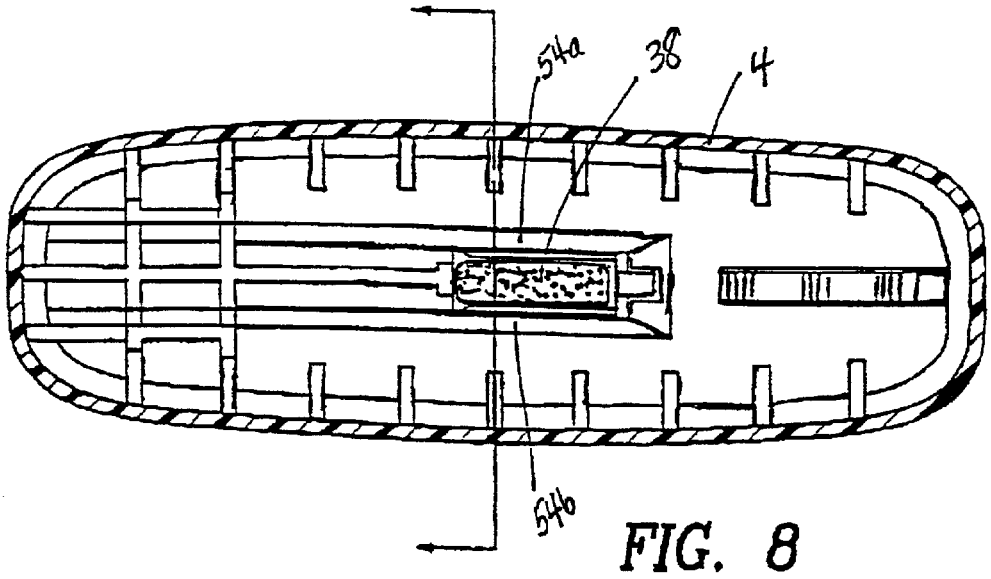
FIG. 8 is a top view of the solid dosage form dispensing device shown in FIG. 1 with the lid removed.

Referring again to FIGS. 1–4, the lower portion of the dispenser 2 is in the form of a solid dosage form releasing portion 12 having a side opening 14 for insertion of a solid dosage form releasing device 16 as hereinafter described and a bottom opening 20 for releasing a solid dosage form to the user. As shown in FIG. 5, the solid dosage releasing portion 12 and the releasing device 16 may be secured within a removable protective cover 46 operatively secured in place about the releasing portion 12 through engagement with a flange 74 as hereinafter described. The cover 46 is removed when the user wishes to dispense a solid dosage form and then resecured to the dispenser when the dispenser is not being used. As will be explained in detail hereinafter, the cover 46 may be releasably secured to the housing 4 in a manner which provides a moisture preventing seal system to further assist in maintaining the stored solid dosage forms in a substantially moisture free environment.

The solid dosage releasing device 16 as shown best in FIG. 5 comprises a housing 22 which in the embodiment shown in FIG. 5 is in the form of a U-shaped wall enclosure 24 having a forward opened portion 26. It will be understood that the enclosure 24 may have other shapes. Extending from the wall enclosure 24 at said opened portion 26 are a pair of opposed flexible arms 28A and 28B. These arms are adapted to engage an opposed wall 50 of the releasing portion 12 as best shown in FIGS. 6 and 7. As explained in detail hereinafter, the flexible arms 28A and 28B are movable from a compressed position when the releasing device 16 is moved to the active position for releasing a single solid dosage form to a passive position when the releasing device 16 is at rest.

Also extending from the U-shaped wall enclosure 24 at the forward opened portion 26 is an optional stopper 30 which prevents access to the single solid dosage form which is suspended above the bottom opening 20 when the releasing device 16 is in the passive position. As explained in detail hereinafter, when the releasing device 16 is in the passive position, the next available solid dosage form is suspended above the stopper 30 in a predetermined orientation ready to be released when the releasing device 16 is moved to the active position and the stopper 30 is moved away from the bottom opening 20.

Figure 13:
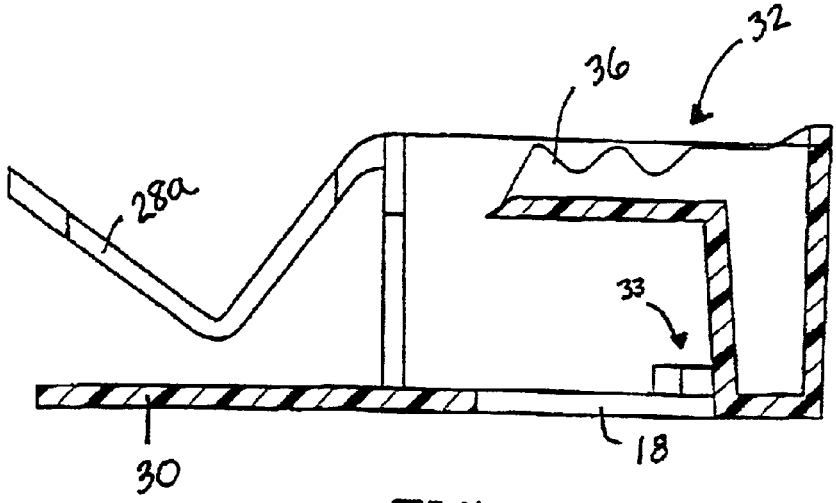
FIG. 13 is a cross-sectional view of the solid dosage form releasing device shown best in FIG. 5.
Figure 15:
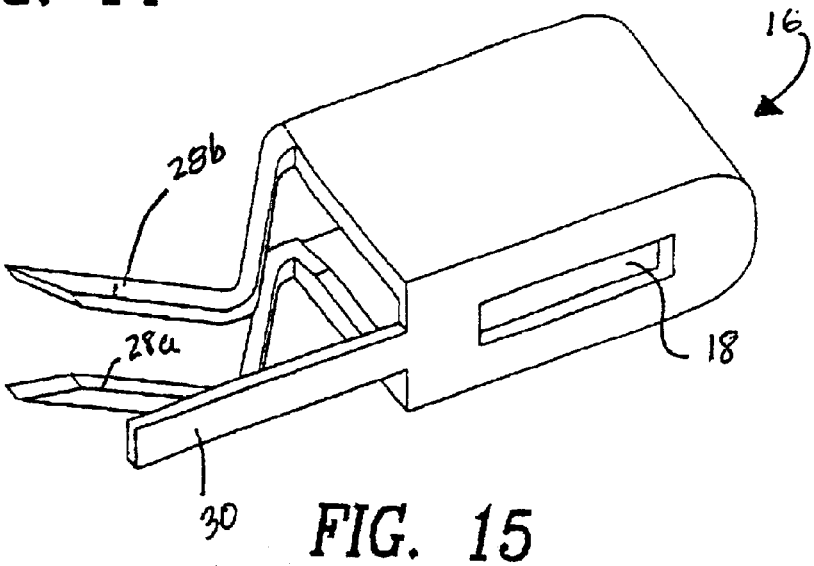
FIG. 15 is a bottom perspective view of the solid dosage form releasing device shown in FIG. 13.

The wall enclosure 24 has a bottom opening 18 (See FIGS. 13 and 15) which is coincident with the bottom opening 20 of the releasing portion 12 when the releasing device 16 is moved to the active position to provide a clear pathway for the release of a single dosage form in the predetermined orientation.

Within the U-shaped wall enclosure 24, there is provided a pair of cam devices 33 (See FIGS. 7B, 13 and 14) which serve to release the suspended single dosage form from the dispenser when the releasing device 16 is moved to the active position.

As shown best in FIGS. 5 and 7A, an optional solid dosage form agitation device 32 is provided within the U-shaped wall enclosure 24. The agitation device 32 has an upper irregular surface 36 which contacts the bottom most solid dosage forms contained within the storage compartment 6 to thereby provide sufficient agitation or tumbling action so that the solid dosage forms in contact therewith do not jam or otherwise obstruct the pathway leading from the storage compartment 6 when the releasing device 16 is moved to the releasing portion 12.

The U-shaped wall enclosure 24 may also be provided with a mechanism which prevents the releasing device from being inserted too far into the side opening 14 and thus damaging the arms 28A and 28B. As shown specifically in FIG. 5, a projection 60 is provided at the end of the wall enclosure 24 which press fits into a notch 62 when the releasing device 16 is secured in the proper position within the side opening 14.

Between the storage compartment 6 and the bottom opening 20 there is provided a delivery assembly for the delivery of a single solid dosage form at a predetermined orientation which facilitates the release of only a single solid dosage form and prevents jamming.

Referring to FIGS. 6–10, the delivery assembly shown generally by the numeral 51 includes a top opening 42 through which the solid dosage forms pass into a pathway 52 which extends from the storage compartment 6 to the bottom opening 20 of the dispenser 2. The pathway 52 is preferably dimensioned to allow only a single dosage form to pass through at a time. The pathway 52 is bounded by a pair of upwardly extending walls 54*a* and 54*b* having a distance therebetween less than twice the amount of a preselected dimension of a solid dosage form 38 so that only a single solid dosage form may enter. Toward the lower portion 56 of the walls 54*a* and 54*b* are a pair of inwardly extending projections, 58*a* and 58*b* best shown in FIGS. 9 and 10, which further narrow the width of the pathway 52 to a width slightly greater than the preselected dimension of the solid dosage form and are thereby used to support the single solid dosage form within the pathway 52 so that it may be released therefrom when the user moves the releasing device 16 from the passive to the active position.

As shown in FIG. 6, a solid dosage form 38 moves from the storage compartment 6 to a desirable predetermined orientation. The single solid dosage form is shown in the pathway 52 in said desirable orientation in FIG. 8.

As used herein the term "predetermined position" shall mean any position in which only a single dosage form is positioned within the delivery assembly and delivered through the bottom opening of the dispenser. By way of example, the predetermined position may be a position as shown specifically in the drawing figures in which the longest dimension of the solid dosage form extends axially in the pathway of the delivery assembly. The present device also encompasses, for example, an orientation in which the longest dimension of the solid dosage form extends radially within the pathway.

Figure 9:
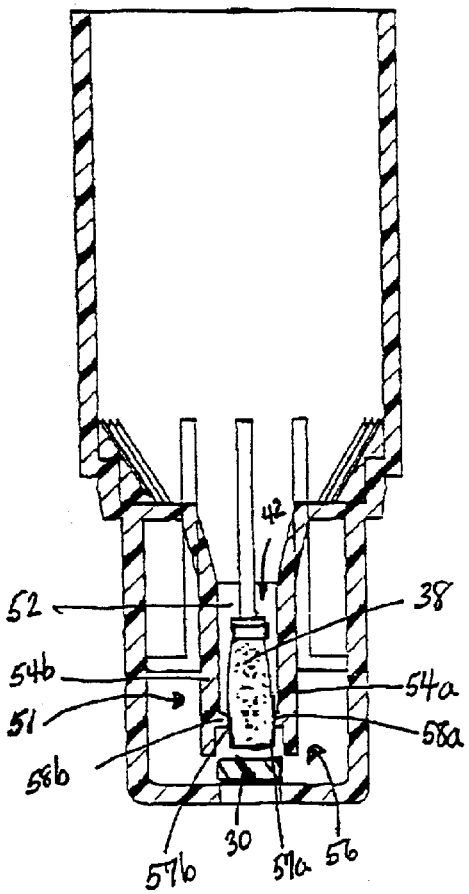
FIG. 9 is a cross-sectional view taken through line 9—9 of FIG. 8 showing one embodiment of the manner in which a single solid dosage form is secured to the releasing device prior to release therefrom.

When in the predetermined position, the single solid dosage form 38 within the pathway 52 is bounded by the upwardly extending walls 54*a* and 54*b* having inwardly extending projections 58*a* and 58*b*. in one embodiment of the invention as shown specifically in FIG. 9 the dosage form 38 has a pair of opposed convex faces 57*a* and 57*b* in which the widest portion thereof is in the middle of the solid dosage form 38. The narrow surfaces below the middle portion of the solid dosage form are particularly suited to be engaged by the corresponding projections 58*a* and 58*b*. As a result the dosage form 38 is suspended in the position shown in FIG. 9 with the bottom portion thereof positioned above the optional stopper 30 which is in position for closing off the bottom opening 20 of the dispensing device 2 if desired.

The release of the dosage form 38 from the predetermined position shown in FIG. 9 takes place by spreading the walls 54*a* and 54*b* away from each other so that the projections 58*a* and 58*b* disengage from the convex surfaces 57*a* and 57*b* of the solid dosage form 38. The spreading of the walls 54*a* and 54*b* is made possible by the cam device 33 within releasing device 16.

Figure 14:
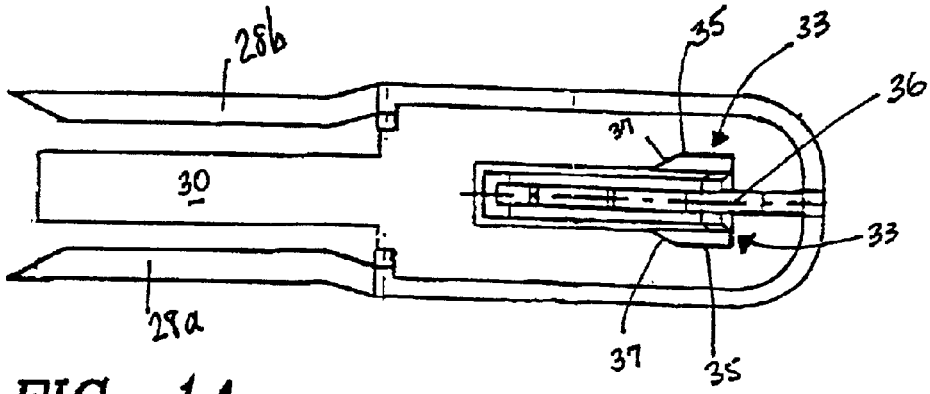
FIG. 14 is a top view of the solid dosage form releasing device shown in FIG. 13.

As shown in FIG. 14, each of the cam devices 33 is comprised of base 35 and a tapered end 37. The tapered end 37 is adapted to contact the lower portion 56 of the walls 54*a* and 54*b* shown in FIG. 9 when the releasing device is moved by the user to the active position. As the lower end of the walls 54*a* and 54*b* engage the tapered end 37 of the respective cam devices 33, they are caused to move a sufficient distance away from each other to release the dosage form from contact with the projections 58*a* and 58*b*. At the same time and by the same movement of the releasing device 16, the stopper 30 if present moves away from the bottom opening 20 to provide an unimpeded pathway for the release of the dosage form so that it may drop from the dispensing device as shown in FIG. 7A.

Figure 10:
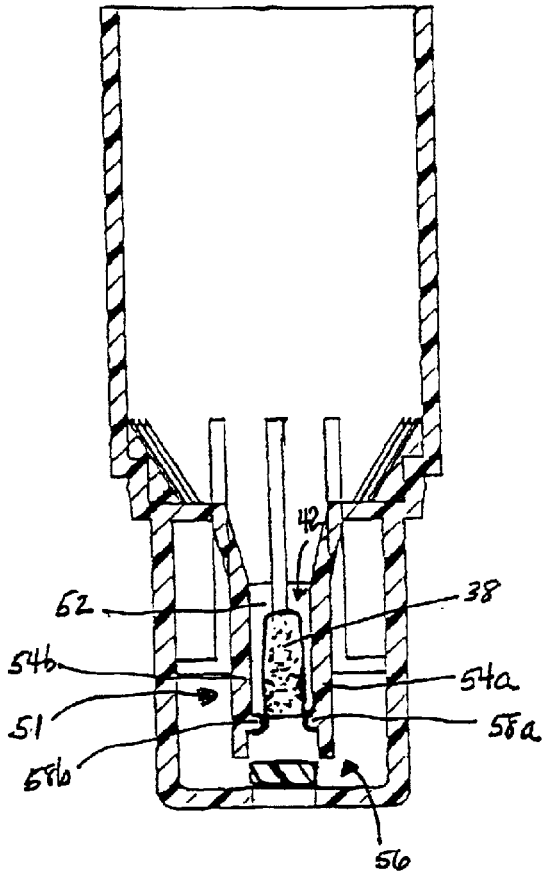
FIG. 10 is a cross-sectional view similar to FIG. 9 showing another embodiment of the manner in which a single solid dosage form is secured to the releasing device.

In a further embodiment of the invention as shown best in FIG. 10, the projections 58*a* and 58*b* do not engage the sides of the dosage form 38 but instead provide a platform on which the solid dosage form rests when the releasing device 16 is in the passive position. This embodiment of the invention may be used for solid dosage forms having generally planar opposed faces. When the releasing device 16 is moved to the active position, the cam devices 33 engage the lower portion 56 of the walls 54*a* and 54*b* as previously described and thereby release the dosage form 38 by moving the projections 58*a* and 58*b* away from each other. The optional stopper 30 is simultaneously moved away from the bottom opening 20 of the dispensing device 2 to provide an unimpeded pathway for the release of the single solid dosage form to the user.

The preferred releasing device 16 of the present invention will be described with reference to FIGS. 5 and 13–15 as set forth below. The releasing device 16, as previously indicated, includes a pair of flexible arms 28A and 28B which provide a spring-like action enabling the releasing device 16 to be moved from a passive position as specifically shown in FIG. 6 to an active position (shown in FIG. 7A) where the arms 28A and 28B are compressed and under tension. The optional stopper 30 blocks the bottom opening 20 (see FIG. 6) in the releasing portion 12 when the releasing device 16 is in the passive position. When the releasing device 16 is moved to the active position, the stopper 30 is retracted thereby removing the obstruction to the bottom opening 20 allowing a single dosage form to fall therethrough and thereby be released form the dispenser 2 as the cam devices 33 engage the walls 54*a* and 54*b* as previously described.

There is also provided in a preferred embodiment of the invention an agitation device 32 having an irregular surface 36 which as shown best in FIG. 7A engages solid dosage forms at the bottom of the storage compartment 6 which are in proximity to the top opening 42 of the storage compartment. The agitation or disruption of the bottommost solid dosage forms within the storage compartment prevents the solid dosage forms from becoming lodged in the top opening 42. The agitation device 32 provides further assurance of the entry of a single solid dosage form into the pathway 52 each time the releasing device 16 is activated.

Figure 3:
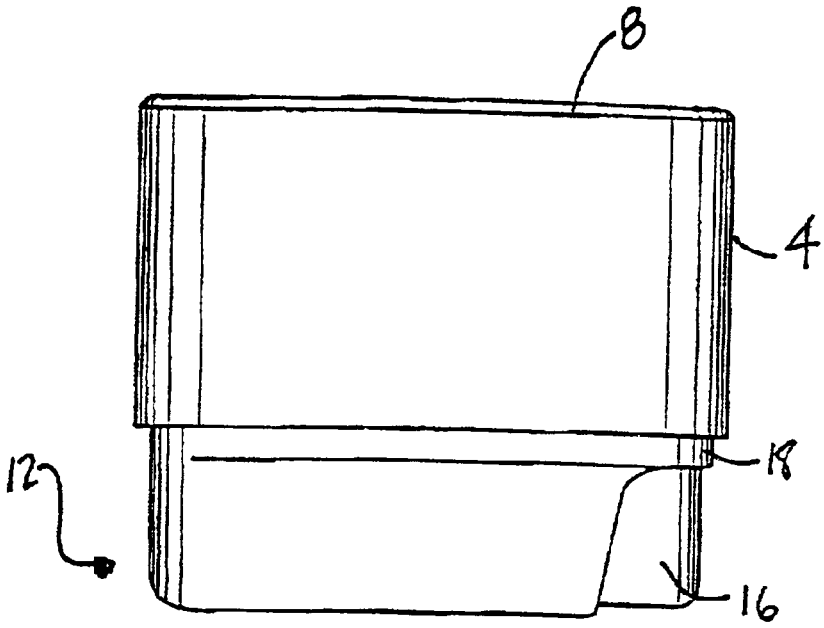
FIG. 3 is a side view of the solid dosage form dispensing device shown in FIG. 1.
Figure 4:
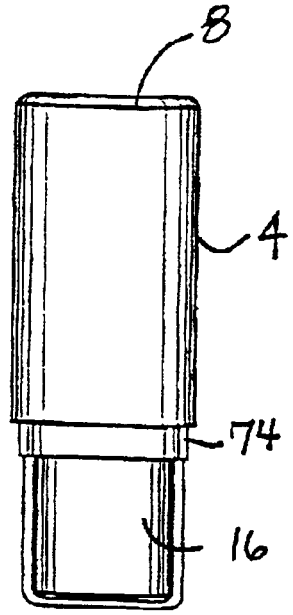
FIG. 4 is a front view of the solid dosage form dispensing device shown in FIG. 1.

In operation, the dispenser 2 of the present invention as best shown in FIG. 3 has the releasing device 16 in the passive position in which the bottom opening 20 of the releasing portion 12 is obstructed by the optional stopper 30 extending from the releasing device 16. When the user wishes to obtain a single solid dosage form, the releasing device 16 is pushed inwardly into the releasing portion 12 from the position shown in FIG. 6 to the position shown in FIG. 7A. As the releasing device 16 is moved inwardly into the releasing portion 12, the cam devices 33 engage the walls 58*a* and 58*b* causing the projections 56*a* and 56*b* to disengage from the solid dosage form 38. At the same time, the optional agitation device 32 begins to contact and tumble the solid dosage forms contained in proximity to the top opening 42 in the storage compartment 6. This ensures that another single solid dosage form in proximity to the top opening 42 will enter at the predetermined orientation into the delivery assembly 51 without becoming jammed against other solid dosage forms.

As shown in FIG. 7A, once the solid dosage form (identified by the reference numeral 38) is released through the bottom opening 20, the user releases pressure from the releasing device 16 thereby moving the releasing device 16 to the position shown in FIG. 6 with the flexible arms 28A and 28B moving from the compressed position to the relaxed position of FIG. 6.

In a further preferred form of the invention, within the releasing portion 12 there is provided a ramp 40 having an incline for urging the solid dosage forms resting thereon toward the bottom opening 42 of the storage compartment 6. The inclined ramp 40 further ensures a constant supply of solid dosage forms for release by the dispenser.

The dispensing device of the present invention can be made from any suitable plastic material. Of particular importance is the employment of a suitable plastic for the formation of the flexible arms 28A and 28B. The arms should be sufficiently flexible so that when a moderate force is applied by the user, the arms may be compressed and have sufficient memory and durability that they can return to a relaxed position a sufficient number of times to release all of the solid dosage forms that may be contained in the pill dispenser or any refills provided.

In accordance with another preferred aspect of the present invention, the dispensing device 2 is rendered substantially impermeable to water vapor when the device is in the passive position (i.e. when the user is not dispensing a solid dosage form from the device.). It will be understood that when the device is in the active position and a solid dosage form is being released, water vapor (moisture in ambient air) can enter the device through the bottom opening 20. In this aspect of the invention, water vapor is at least substantially prevented from entering the device when the user is not actively releasing a solid dosage form therefrom and a cover 46 is operatively secured to the dispenser.

In this regard, it is also advantageous to provide a cover 46 to protect the releasing portion 12 and the releasing device 16 as well as to keep moisture from entering the dispenser 2 through the bottom portion thereof and particularly through the opening 14 in the releasing portion 12.

Figure 12:
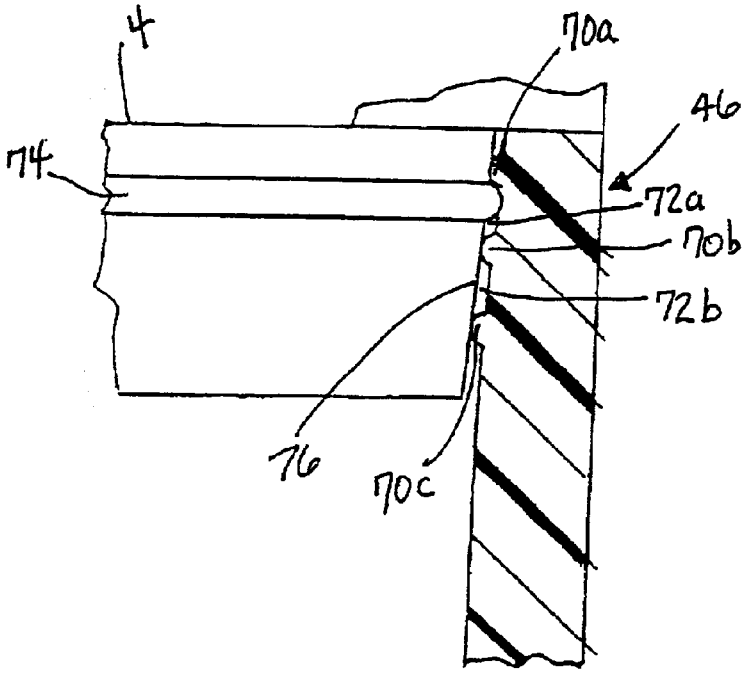
FIG. 12 is a partial cross-sectional view of the seal formed between the cap and housing taken from FIG. 6.

Referring to FIGS. 5, 6 and 12, a cover 46 is releasably secured to the lower portion of the housing 4 in a manner which substantially prevents moisture from entering the device. The cover must be removed when the user desires to dispense a solid dosage form. As shown best in FIG. 12, the cover 46 is releasably secured to the housing 4, preferably through a multiple seal barrier, as described hereinafter. The cover 46 is provided with at least two, preferably more than two projections 70 (three projections 70*a*, 70*b*, and 70*c* are shown in FIG. 12. Between each pair of projections is a trough 72*a* and 72*b*, respectively which provides a place of contact for a corresponding flange 74 located on the surface of the housing 4. Contact of the flange 74 to the trough surface (72*a* as specifically shown in FIG. 12) provides a seal which prevents the influx of moisture into the device.

In addition, the housing 4 may be provided with a tapered surface 76 which provides individual sealing surfaces for each of the remaining projections (e.g. 70*b* and 70*c* as shown specifically in FIG. 12) and thus provides additional barriers against the influx of moisture.

As previously indicated, the dispenser 2 may be provided as a unitary or integral structure with a lid permanently secured to the top portion of the housing 4. Alternatively, the lid 8 may be removable for the purpose of adding a new supply of solid dosage forms to the dispenser. The desirability of either a unitary construction or a removable lid will depend in part on the type of solid dosage form and its sensitivity to moisture.

As previously explained, the lid 8, if present, may be permanently sealed to the upper portion of the housing 4 or may be releasably secured thereto. If the dispensing device is constructed with a lid which can be removed from the housing, it is desirable to provide at least one moisture preventing sealing interface to assist in preventing unwanted moisture from contacting the solid dosage forms which may be present in the storage compartment.

Figure 11:
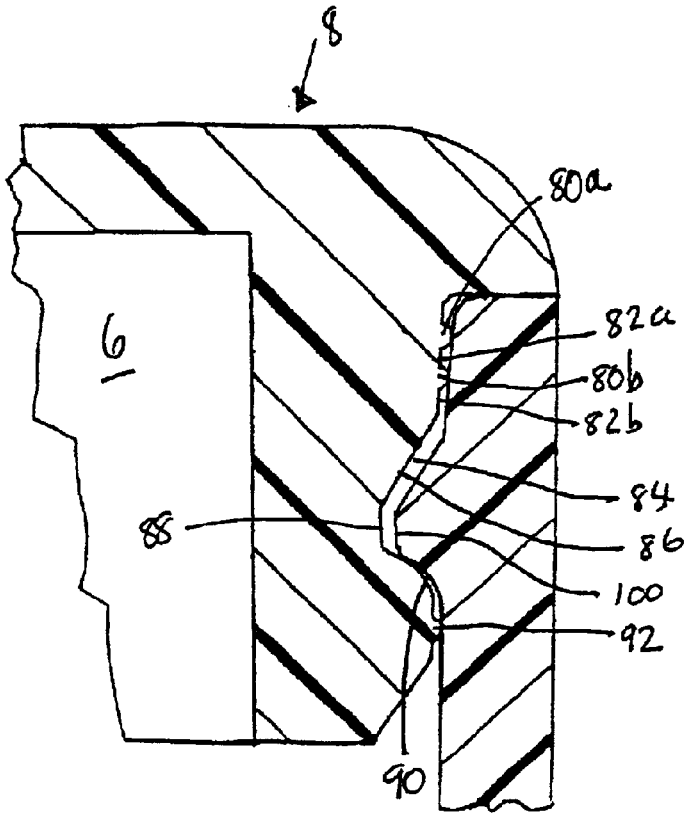
FIG. 11 is a partial cross-sectional view of seal formed between the lid and the housing of the dispensing device taken from FIG. 7A.

Referring to the embodiment of the invention shown specifically in FIGS. 7A and 11, the lid 8 has a pair of projections 80*a* and 80*b* defining corresponding trough surfaces 82*a* and 82*b*. There is also provided an indentation 84 defined by an inwardly tapering surface 86, a downwardly extending surface 88 and an outwardly extending surface 90 below which is a projection 92. The corresponding inner surface 100 of the housing 4 has a contour which provides sealing contact with the lid 8 at the projections 80*a* and 80*b*, along at least one of the surfaces 86, 88 and 90 and with the projection 92. Thus there are at least three sealing surfaces in a preferred embodiment of the invention to prevent moisture from entering the dispensing device 2 through the lid 8.

The embodiments shown herein are for illustrative purposes only and modifications thereof which would be apparent to one of ordinary skill in the art or within the full scope of the invention.

What is claimed is:

1. A dispenser for dispensing a solid dosage form comprising:

a) a first housing comprising a storage compartment for storing the solid dosage form having a first opening, a solid dosage form supporting portion operatively connected to the storage compartment for receiving and supporting a solid dosage form received through the first opening and having a second opening for receiving a solid dosage form releasing device, and a third opening for releasing the solid dosage form from the dispenser; and b) said solid dosage form releasing device comprising a U-shaped wall enclosure having:

1) at least one flexible arm extending therefrom which is engageable with the first housing to enable the releasing device to move from an active to a passive position;

2) a pair of opposed cam devices for engaging the solid dosage form supporting portion to thereby releasing the supported solid dosage form contained therein when the releasing device is in the active position; and 3) a member comprising an agitation device;

wherein the solid dosage form supporting portion is in communication with the storage compartment in the passive position, and in communication with the third opening in the active position and wherein the member moves in a direction substantially perpendicular to a path traveled by the solid dosage form moving from the storage compartment to the solid dosage form supporting portion, wherein the member isolates the form supporting portion from the storage compartment in the active position.

2. The dispenser of claim 1 wherein the solid dosage form supporting portion comprises a pathway extending from the storage compartment to the third opening, upstanding walls defining a pathway permitting only a single solid dosage form to pass therethrough at a time and opposed projections extending inwardly from the upstanding walls to loosely secure said single solid dosage form within the pathway until the solid dosage form is released from the dispenser.

3. The dispenser of claim 2 wherein the bottom of said single dosage form rests on the opposed projections when the single solid dosage form is loosely secured within the pathway.

4. The dispenser of claim 2 wherein the opposed projections press against the opposed sides of said single solid dosage form when loosely secured within the pathway.

5. The dispenser of claim 4 wherein the opposed sides of the single solid dosage form have convex surfaces, said opposed projections engaging said convex surfaces to loosely secure the single solid dosage form within the pathway.

6. The dispenser of claim 2 further comprising a lid secured to an upper end of the first housing in a substantially moisture tight seal.

7. The dispenser of claim 2 further comprising a cap covering the solid dosage form releasing device in a substantially moisture tight seal when the cap is secured to the first housing.

8. The dispenser of claim 1 wherein the agitation device further comprises an upwardly extending wall having an irregular surface for agitating the solid dosage forms contained within the storage compartment when the solid dosage form releasing device is moved to and from the active position.

9. A dispenser for dispensing a solid dosage form comprising:

a housing having a storage compartment for stating the solid dosage form and an aperture for dispensing the solid dosage form; and a releasing device moveable between a first position and a second position, the releasing device comprising a supporting portion for receiving a solid dosage form from the storage compartment and a member comprising an agitation device;

wherein the supporting portion is in communication with the storage compartment in the first position, and the supporting portion is in communication with the aperture in the second position, and wherein the supporting portion is disengaged from the solid dosage form when the releasing device is in the second position, and wherein the member moves in a direction substantially perpendicular to a path traveled by the solid dosage form moving from file storage compartment to the supporting portion, wherein the member isolates the supporting portion from the storage compartment in the second position;

wherein the supporting portion further comprises at least one projection.

10. The dispenser of claim 9 further comprising at least one biasing member coacting with the releasing device.

11. The dispenser of claim 10 wherein the biasing member biases the releasing device toward the first position.

12. The dispenser of claim 9 wherein the member comprises a surface configured to contact a solid dosage form in the storage compartment.

13. The dispenser of claim 12 wherein the surface is an uneven surface.

14. The dispenser of claim 9 wherein the releasing device further comprises a pathway in communication with the storage compartment in the first position.

15. The dispenser of claim 14 wherein the pathway is sized to receive only a single solid dosage form.

16. The dispenser of claim 9 wherein the at least one projection is disengaged from the solid dosage form when the releasing device is in the second position.

17. The dispenser of claim 16 wherein the supporting portion receives the solid dosage form by at least one of resting the solid dosage form on the at least one projection and pressing the at least one projection against a side of the solid dosage form.

18. The dispenser of claim 16 further comprising a surface to coact with the at least one projection to disengage the at least one projection from the solid dosage when the releasing device is in the second position.

19. The dispenser of claim 17 wherein the surface is a cam surface.

20. The dispenser of claim 9 wherein the storage compartment further comprises at least one of a lid, a removable lid, and a lid with at least one sealing surface.

21. The dispenser of claim 9 further comprising a cap covering the releasing device.

* * * * *